US008936539B2

(12) United States Patent
Richard et al.

(10) Patent No.: US 8,936,539 B2
(45) Date of Patent: Jan. 20, 2015

(54) BALANCE BOARD EXERCISE APPARATUS

(71) Applicants: Jason Richard, Overland Park, KS (US); Stephen M. Pope, Kansas City, MO (US)

(72) Inventors: Jason Richard, Overland Park, KS (US); Stephen M. Pope, Kansas City, MO (US)

(73) Assignee: Fit In Fitness, LLC, Overland Park, KS (US)

( * ) Notice: Subject to any disclaimer, the term of this patent is extended or adjusted under 35 U.S.C. 154(b) by 148 days.

(21) Appl. No.: 13/627,835

(22) Filed: Sep. 26, 2012

(65) Prior Publication Data

US 2014/0087927 A1 Mar. 27, 2014

(51) Int. Cl.
*A63B 22/16* (2006.01)

(52) U.S. Cl.
USPC ..... 482/123; 482/129; 482/130

(58) Field of Classification Search
CPC ..... A63B 22/14; A63B 22/16; A63B 23/04; A63B 26/00
USPC ..... 482/92, 121–126, 129–130
See application file for complete search history.

(56) References Cited

U.S. PATENT DOCUMENTS

| | | | | | |
|---|---|---|---|---|---|
| 2,829,891 | A * | 4/1958 | Ludwig | 482/146 |
| 4,787,630 | A * | 11/1988 | Watson et al. | 482/146 |
| 5,352,176 | A * | 10/1994 | Huang | 482/146 |
| 6,146,343 | A * | 11/2000 | Stewart | 601/118 |
| 6,447,429 | B1 * | 9/2002 | Chen et al. | 482/79 |
| 6,461,285 | B1 * | 10/2002 | Theunissen et al. | 482/146 |
| 6,872,175 | B2 * | 3/2005 | Lin | 482/146 |
| 7,008,359 | B2 * | 3/2006 | Fan et al. | 482/146 |
| 7,112,168 | B2 * | 9/2006 | Dalebout et al. | 482/146 |
| D604,374 | S * | 11/2009 | Bizzell | D21/688 |
| D605,712 | S * | 12/2009 | Bizzell | D21/688 |
| D606,134 | S * | 12/2009 | Bizzell | D21/688 |
| D606,600 | S * | 12/2009 | Bizzell | D21/688 |
| 2004/0009859 | A1 * | 1/2004 | Gottlieb | 482/146 |
| 2007/0129227 | A1 * | 6/2007 | Suaste | 482/146 |
| 2008/0318743 | A1 * | 12/2008 | Bizzell et al. | 482/142 |
| 2010/0167886 | A1 * | 7/2010 | Ko | 482/123 |
| 2010/0204023 | A1 * | 8/2010 | Mills et al. | 482/121 |

* cited by examiner

*Primary Examiner* — Steve R Crow
*Assistant Examiner* — Gary D Urbiel Goldner
(74) *Attorney, Agent, or Firm* — Dale J. Ream

(57) ABSTRACT

A fitness apparatus for exercising with stretchable and resilient resistance bands includes a body member having a base and a rocker portion extending away from the base, the rocker portion having a generally convex configuration. The fitness apparatus includes a lid member having a generally planar configuration removably coupled to the body member. The lid member defines a pair of oppositely disposed lid member channels configured to receive the resistance bands therethrough for repositionable use in exercise by a user.

11 Claims, 9 Drawing Sheets

BALANCE BOARD EXERCISE APPARATUS

REFERENCE TO RELATED APPLICATIONS

This application claims the priority of Provisional patent application U.S. Ser. No. 61/626,324 filed on Sep. 26, 2012 titled Exercise Apparatus.

BACKGROUND OF THE INVENTION

This invention relates generally to fitness equipment and, more particularly, to a balance board exercise apparatus that enables a user to exercise with resistance bands while balancing on the apparatus in a teetering configuration or in a stationary configuration.

Fitness equipment for use with resistance bands is popular and effective for both aerobic and anaerobic exercise. While resistance bands can simulate lifting weights, they may also be used as part of a more complete aerobic workout. Portable fitness products having built-in resistance equipment that extend out of fixed points exist on the market today, such as the fitness products sold under the trademark names WORKOUT 180™, JOURNEY GYM™, and REEBOK® CORE TRAINER, and the like.

Although assumably effective for their intended purposes, the integrated exercise equipment and resistance bands tend to be unreliable and often experience breakage. Further, equipment currently including resistance bands require users to grasp the band handles from the same point in each iteration of an exercise. Obviously, usage becomes very repetitive, boring, and of limited recurring value. In other words, a user's fitness progress is likely to plateau.

Therefore, it would be desirable to have a balance board style fitness apparatus configured for use with resistance bands that combines the benefits of a balance board with the benefits of resistance band training. Specifically, a balance board causes a user's core muscles to fire repeatedly as the board is balanced. Further, it would be desirable to have a balance board style fitness apparatus that enables the position of resistance bands to be adjusted by a user both before and during exercise. Combining a balance board workout with resistance bands that may be repositioned provides an improved and beneficial health benefit.

SUMMARY OF THE INVENTION

A fitness apparatus for exercising with stretchable and resilient resistance bands according to the present invention includes a body member having a base and a rocker portion extending away from the base, the rocker portion having a generally convex configuration. The fitness apparatus includes a lid member having a generally planar configuration removably coupled to the body member. The lid member defines a pair of oppositely disposed lid member channels configured to receive the resistance bands therethrough for repositionable use in exercise by a user.

Therefore, a general object of this invention is to provide a fitness apparatus having a portable, rocker-style balance board configured for use with resistance bands.

Another object of this invention is to provide a fitness apparatus, as aforesaid, that enables a user to stand atop the balance board and position resistance bands at desired locations so as to exercise various muscle groups.

Still another object of this invention is to provide a fitness apparatus, as aforesaid, having a pair of T-track channels that enable the resistance bands to be repositioned with the user's feet while exercising, thus varying the degree of resistance.

Yet another object of this invention is to provide a fitness apparatus, as aforesaid, that may be configured as a rocker-style balance board or as a more challenging wobble board.

A further object of this invention is to provide a fitness apparatus, as aforesaid, having storage space for fitness equipment.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A balance board exercise apparatus according to a preferred embodiment of the present invention will now be described with reference to FIGS. 1*a* to 7*b* of the accompanying drawings. The exercise apparatus 10 includes a body member 40 and a lid member 20 that may be configured in a teetering/rocking configuration or in a stabilized configuration. The body member 40 may also be referred to as a rocker board whereas the lid member 20 may also be referred to as a wobble board, as will become clear when the structure of each has been described in detail below.

Figure 1A:
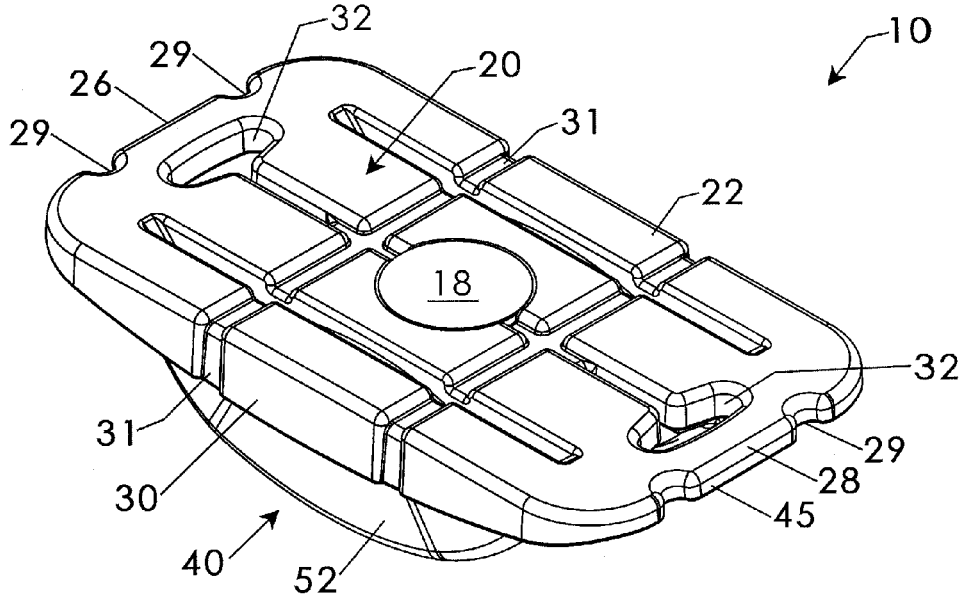
FIG. 1*a* is a perspective view of a balance board exercise apparatus according to a preferred embodiment of the present invention in a rocker board configuration from an elevated angle.
Figure 5:
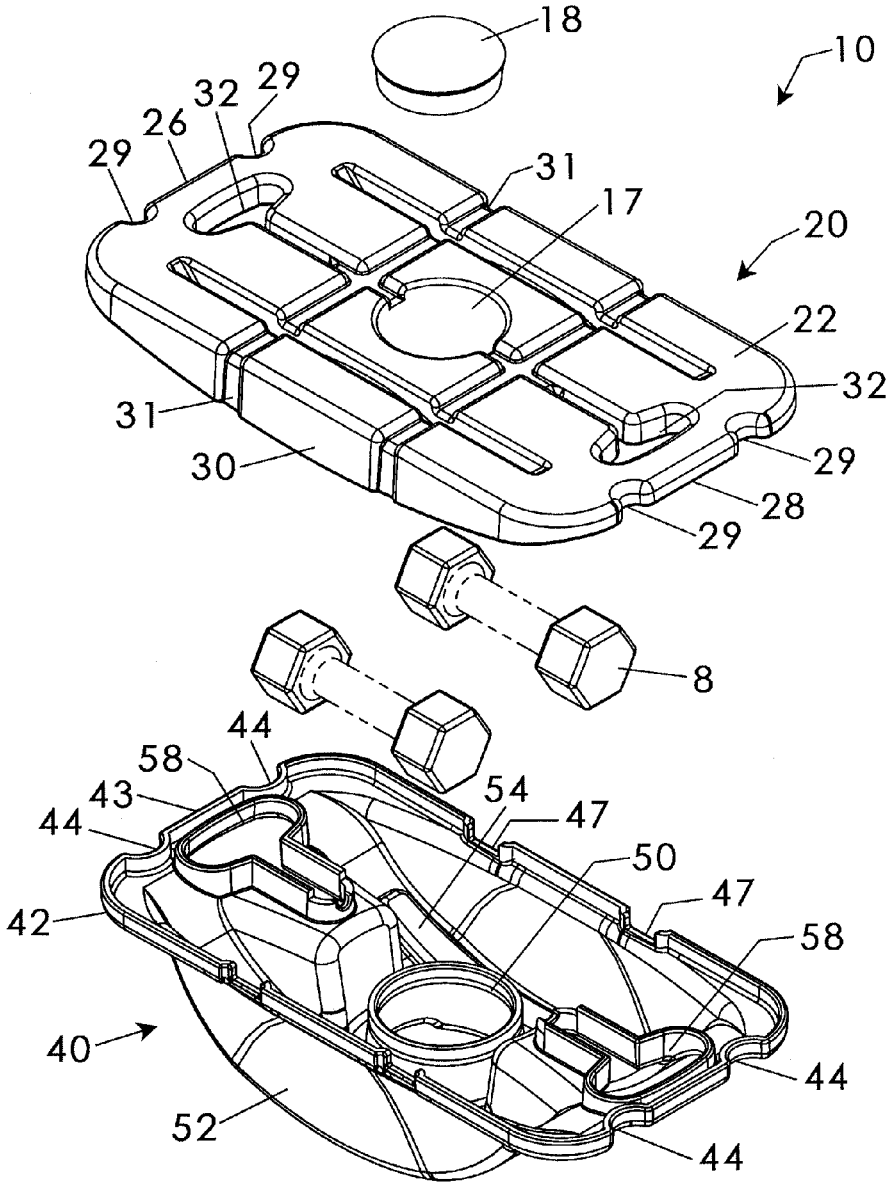
FIG. 5 is an exploded view of the exercise apparatus as in FIG. 1*a;*

The lid member 20 includes a generally planar configuration having an outer surface 22 (FIG. 1*a*) and an inner surface 24 (FIG. 7*b*). The outer surface 22 may include a gripping texture, coating, or overlaid material that provides traction to a user standing thereon. The lid member 20 may include opposed first 26 and second 28 ends and a pair of lid member side walls 30 extending therebetween. The lid member side walls 30 extend downwardly from the outer surface 22 (FIG. 5). The lid member 20 defines a pair of oppositely disposed lid member channels 32, each lid member channel 32 being positioned generally adjacent a lid member end 26, 28, respectively (FIGS. 1*a* and 5). Each lid member channel 32 may include a generally T-shaped configuration with the largest portion of the lid member channel 32 being adjacent a respective lid member end 26, 28, respectively. The largest portion of the channel 32 is large enough to receive a person's hand and the handle of a resistance band therethrough as will be described in more detail later. Each lid member channel 32 may be referred to herein as a T-track channel. Each lid member channel 32 may be defined by a plurality of channel walls extending away from the inner surface 24 (FIG. 7*b*). The lid member 20 may define a central opening 17 and a cover 18 specifically configured to selectively cover the opening 17. The opening 17 provides access to the balance device 33 when the cover 18 is removed.

The lid member 20 includes a balance device 33 coupled to the inner surface 24 of the lid member 20 and extending downwardly therefrom. The balance device 33 extends downwardly further than the lid member side walls 30 (FIG. 7*b*). The balance device 33 includes an upper portion 34 having a generally cylindrical configuration and a lower portion 35 having a convex configuration. Preferably, the balance device 33 is situated at a center position on the inner surface 24 of the lid member 20 such that the lid member 20 may be balanced thereon. In one embodiment, the balance device 33 may have a spherical configuration. In operation, the lid member 20 may be supported by the balance device 33 on a floor surface. The lid member 20, also known as a wobble board, may wobble side to side as a result of the convex configuration of the lower portion 35 until balanced by a user standing atop the outer surface of the lid member 20 as will be described in more detail later. The lid member 20 further includes at least one flange 36 but preferably two flanges coupled to the inner surface 24 of the lid member 20 (FIG. 7*b*). Each flange 36 is configured to be coupled to a rocker portion receiver channel 54 as will be described later.

The body member 40 includes a base 42 and a rocker portion 52 extending away from the base 42 (FIG. 5). The body member base 42 includes opposed first 43 and second 45 ends with opposed body member side walls 46 extending between the ends 43, 45, respectively. The base 42 includes opposed base channels 58, each base channel 58 being positioned generally adjacent a base end 43, 45, respectively (FIGS. 1*a* and 5). Each base channel 58 may include a generally T-shaped configuration with the largest portion of the base channel 58 being adjacent a respective base end 43, 45, respectively. The largest portion of the base channel 58 is large enough to receive a person's hand and the handle of a resistance band 6 therethrough as will be described in more detail later. Each base channel 58 may also be referred to as a T-track channel. Each base channel 58 may be defined by a plurality of base channel walls extending away from the base (FIG. 5). It is understood that each base channel 58 includes a configuration substantially similar to that of a corresponding lid member channel 32 such that corresponding channels may be coupled together in a friction fit engagement when the lid member 20 is coupled to the body member 40 as will be described below.

The configuration of the T-track channel design (both in the lid member 20 and in the body member 40) provides important functional advantages over any previous design. Resistance bands may be positioned to extend from the corresponding channels. A user, however, is able to positioned the resistance bands anywhere along the channels, such as by moving the bands with his or her feet. This enables the bands to be positioned wherever most comfortable for a user and also to vary the amount of resistance experienced when exercising. The user may vary his own position or that of the resistance bands at any time while standing atop the lid member 20.

The rocker portion 52 includes a generally convex, hemispherical, or annular configuration relative to the base 42. More particularly, the rocker portion 52 is close to the base 42 adjacent respective ends of the body member 40 whereas the rocker portion 52 extends away from the base 42 relative to a midpoint between the body member ends.

The rocker portion 52 defines an interior area (FIG. 5). The base 42 defines an open configuration that provides access to the rocker portion interior area. Preferably, the interior area is configured to receive and contain exercise equipment, such as dumbbells 8 (shown in FIG. 5 in dotted lines) although other items may also be stored therein such as resistance bands, a wallet, keys, or the like. More particularly, the rocker portion 52 may include first and second rocker portion sections. The body member 40 shown in FIG. 6 is in an inverted configuration and illustrates how the rocker portion 52 may actually be a pair of rocker portion sections.

Figure 6:
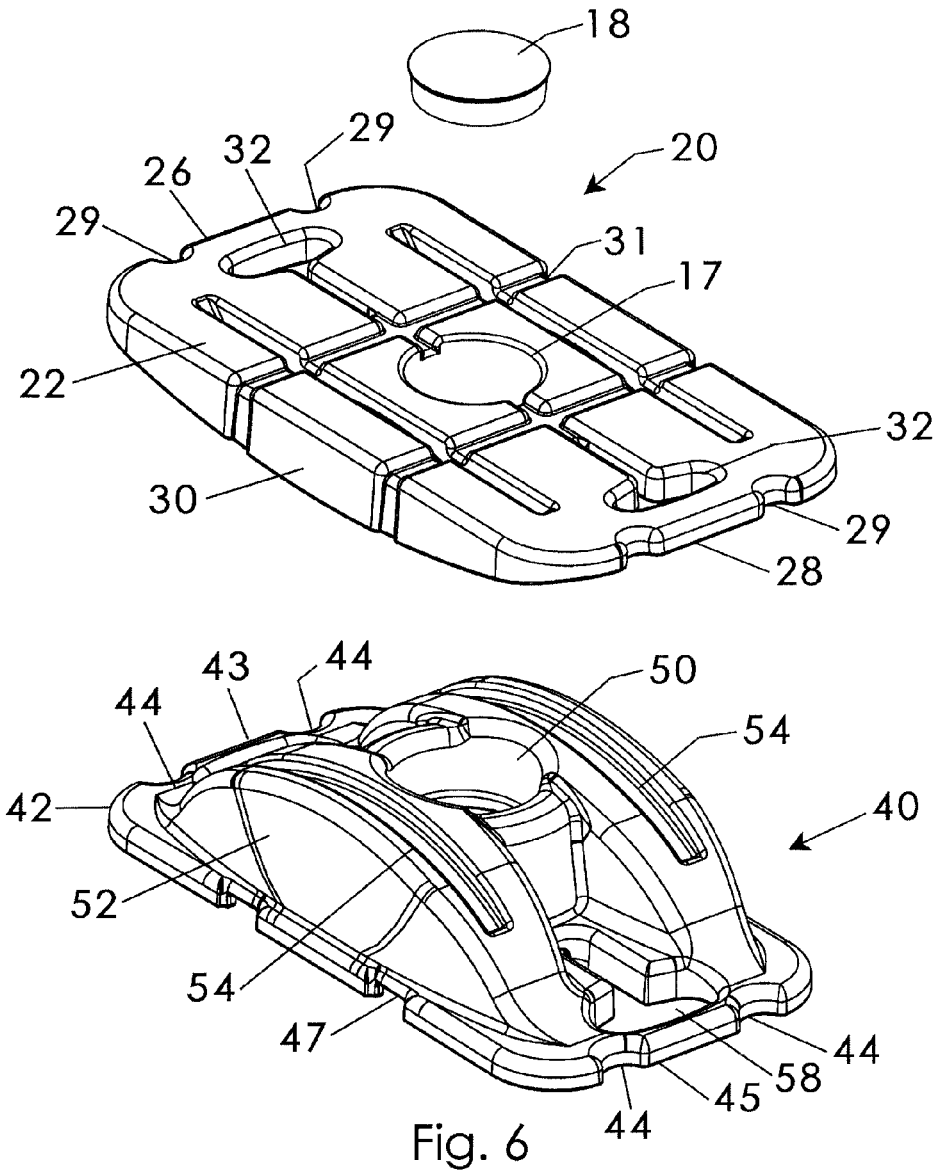
FIG. 6 is an exploded view of the exercise apparatus as in FIG. 2*b;*
Figure 7:
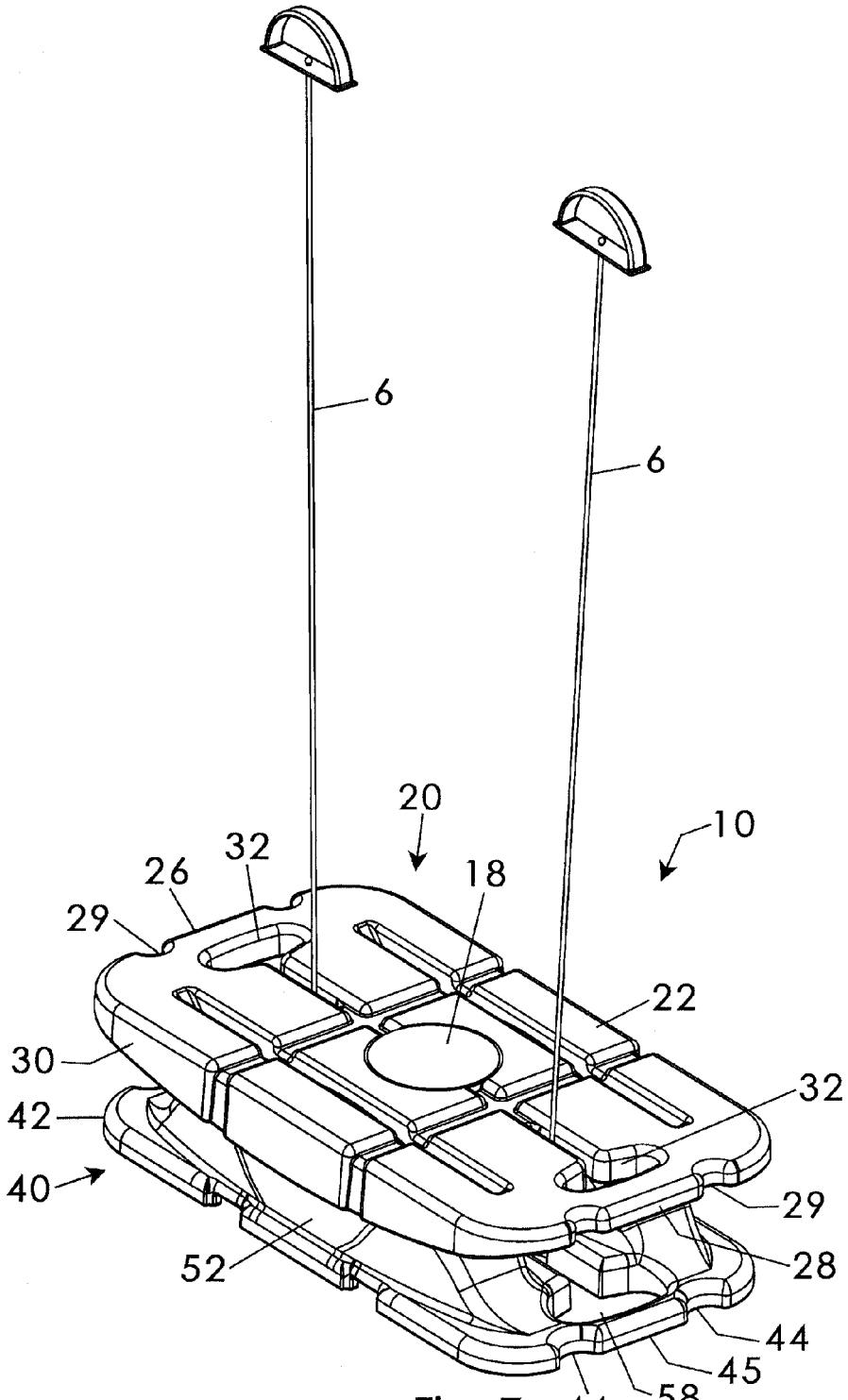
FIG. 7 is a perspective view of the exercise apparatus as in FIG. 2*b* in use with an exercise band.
Figure 8A:
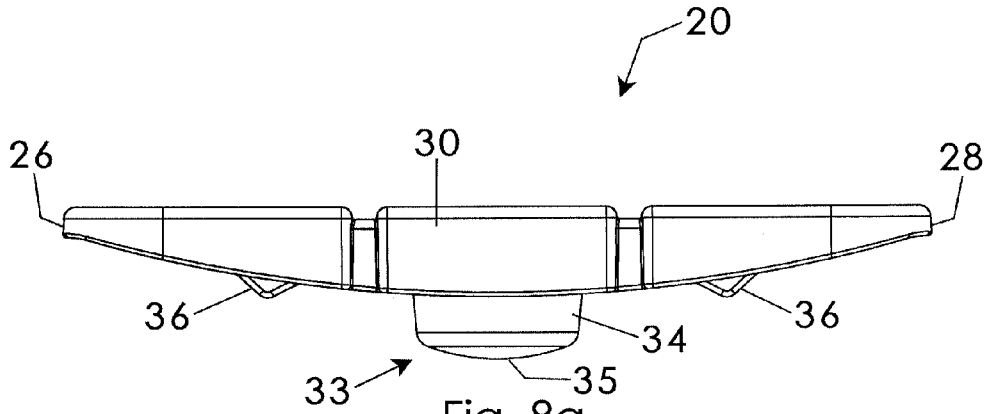
FIG. 8*a* is an isolated side view of the lid member as in FIG. 5.
Figure 8B:
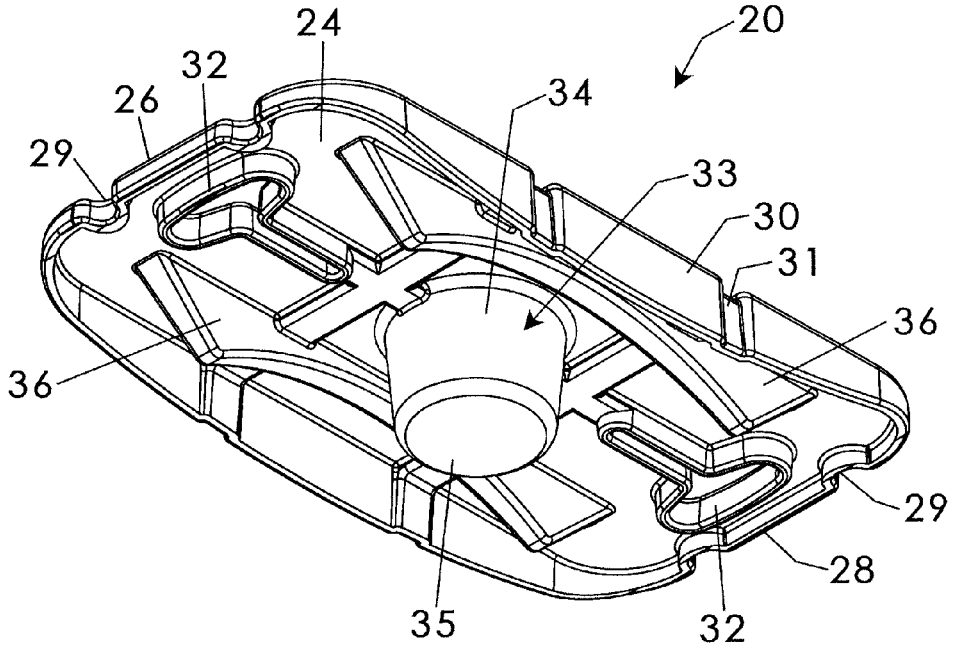
FIG. 8*b* is a perspective view of the lid member as in FIG. 8*a* taken from an underneath angle.
Figure 9A:
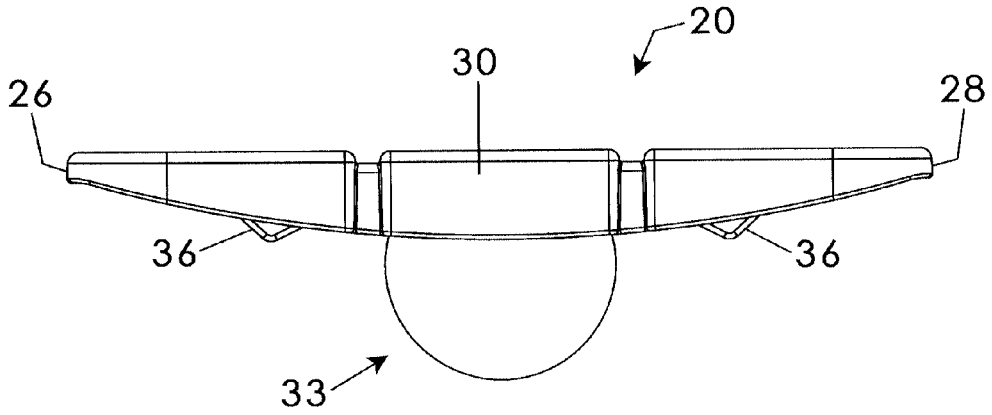
FIG. 9*a* is an isolated side view of the lid member as in FIG. 5 according to another embodiment of the present invention.
Figure 9B:
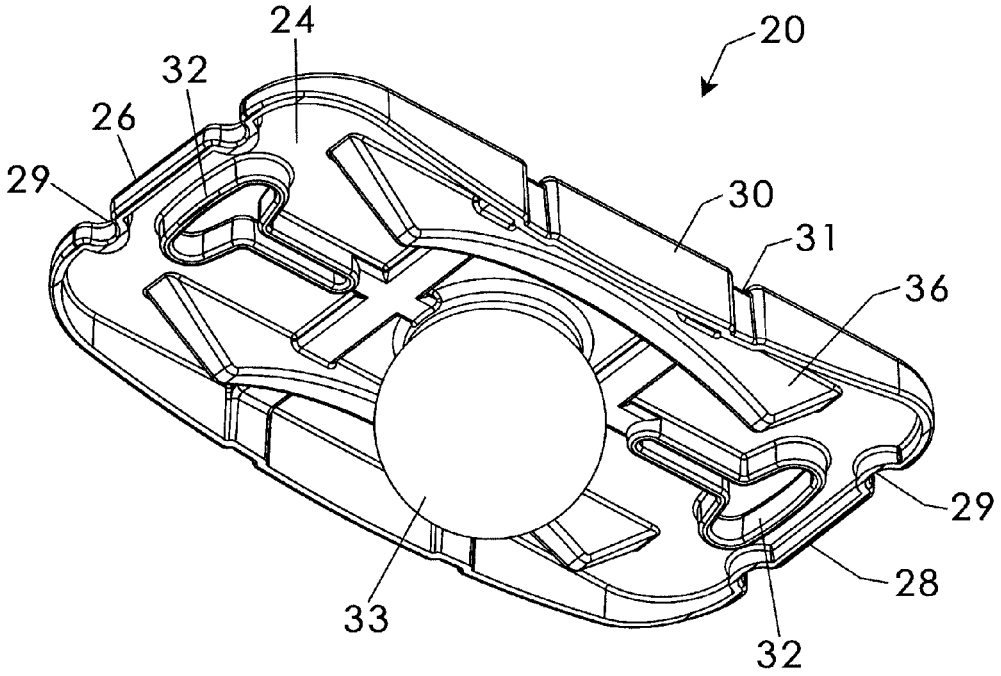
FIG. 9*b* is a perspective view of the lid member as in FIG. 8*a* taken from an underneath angle.

The body member includes a reservoir 50 situated in said rocker portion interior area and includes a generally tubular configuration and defining open ends (FIGS. 5 and 6). The reservoir 50 includes an interior configuration complementary to that of the balance device 33 depending from the inner surface 24 of the lid member 20 and is positioned so as to receive the balance device 33 therein when the lid member 20 is coupled to the body member 40 as will be described below.

Figure 4A:
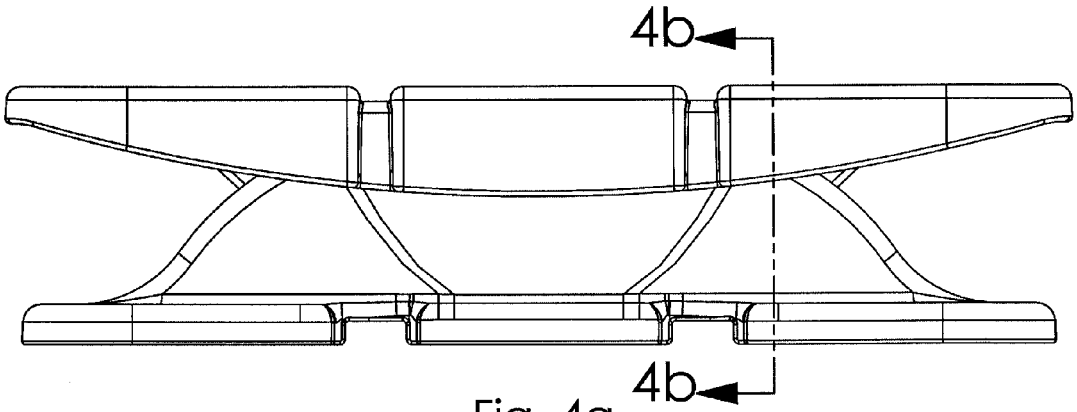
FIG. 4*a* is a side view of the exercise apparatus as in FIG. 2*b;*
Figure 4B:
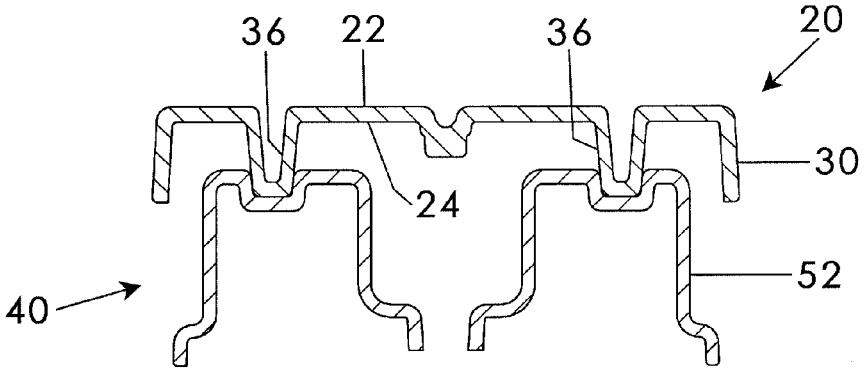
FIG. 4*b* is a sectional view taken along line 4*b*-4*b* of FIG. 4*a;*

As shown in FIG. 6, the rocker portion 52 of the body member 40 defines at least one receiver channel 54 in the outer/lower wall thereof. If the rocker portion 52 includes a pair of rocker portion sections, each section defines a receiver channel 54. Each receiver channel 54 includes a configuration that is complementary to a corresponding lid member flange 36 and is positioned so as to receive a lid member flange 36 when the lid member 20 is coupled to the rocker portion 52 of the body member as will be described in more detail below. FIG. 4*b* specifically illustrates engagement of a pair of lid member flanges 36 into corresponding rocker portion receiver channels 54.

Respective ends of the lid member 20 may define notches 29, each notch 29 having a configuration that is complementary to a resistance band 6 so as to selectively receive a band therein when a user is performing certain exercises. Further, each lid member side wall 30 may define at least one lid member cutout 31 for similarly and selectively receiving a resistance band 6 therein. Similarly, the ends of the body member base 42 and the base side walls 46 may include notches 44 and cutouts 47 corresponding to those of the lid member 20 (FIG. 5).

Figure 1B:
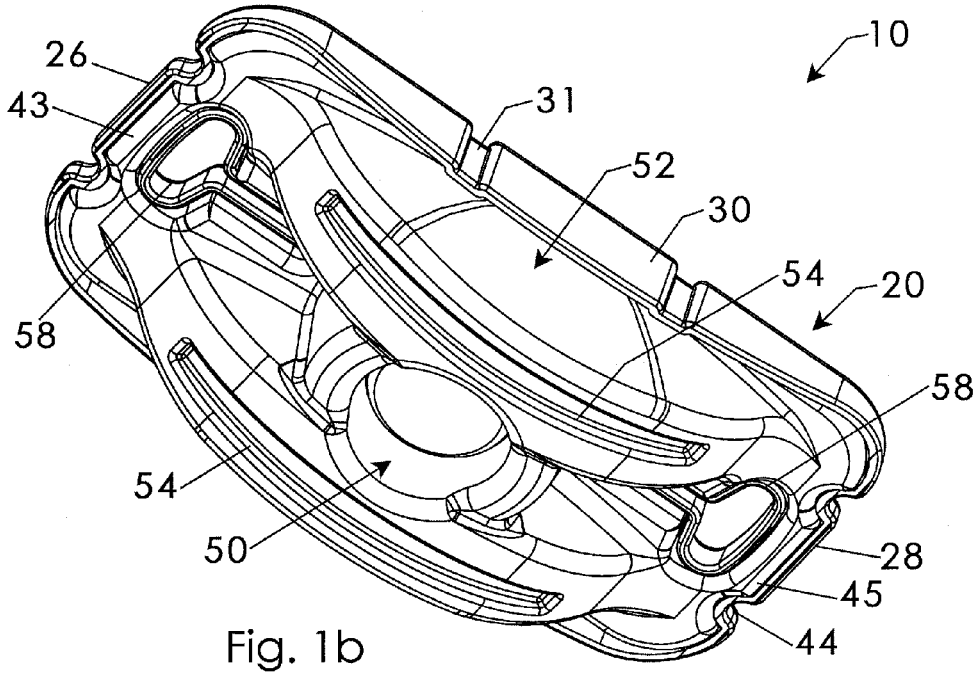
FIG. 1*b* is a perspective view of a balance board exercise apparatus as in FIG. 1*a* taken from an underneath angle.
Figure 2A:
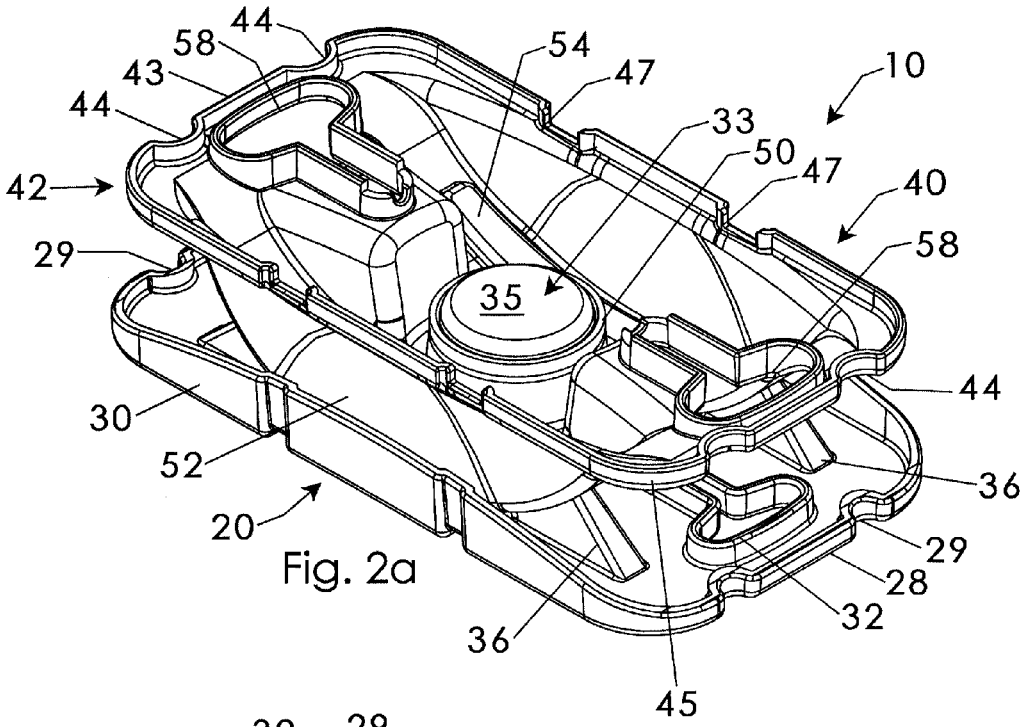
FIG. 2*a* is a perspective view of a balance board exercise apparatus configured in a stabilized and inverted configuration.
Figure 2B:
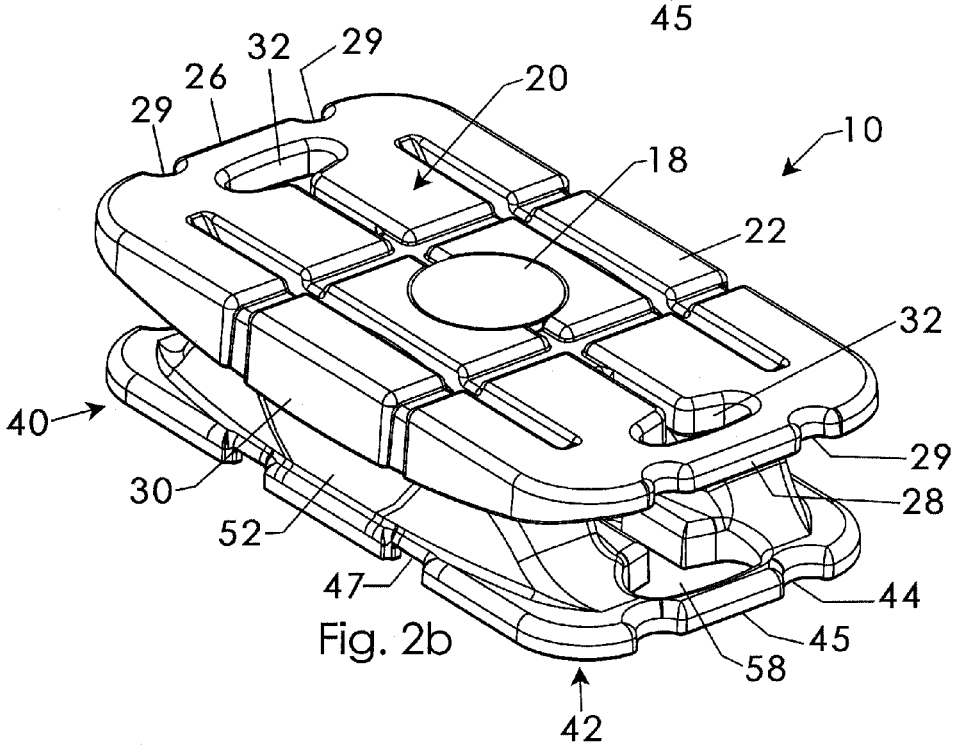
FIG. 2*b* another perspective view of a balance board exercise apparatus in a stabilized and upright configuration.
Figure 3A:
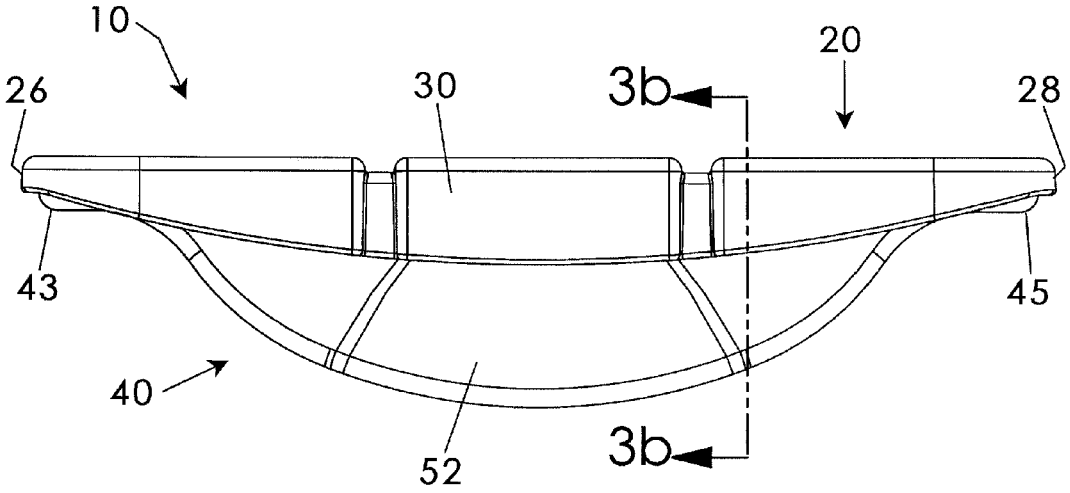
FIG. 3*a* is a side view of the exercise apparatus as in FIG. 1*a;*
Figure 3B:
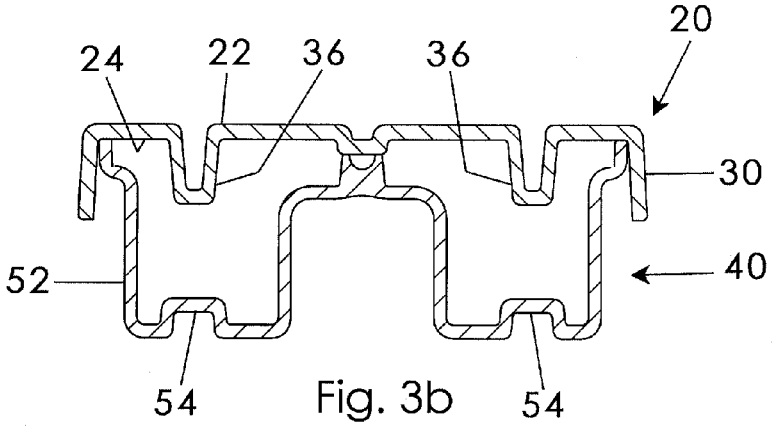
FIG. 3*b* is a sectional view taken along line 3*b*-3*b* of FIG. 3*a;*

The lid member 20 may be selectively coupled to the body member 40 in at least two configurations as will be described below. The lid member 20 may be coupled to the body member 40 to create a balance board or "rocker board" as shown in FIGS. 1*a*, 1*b*, 3*a*, 3*b*, and 5. The lid member 20 and body member 40 may be releasably coupled in a friction fit or snap fit engagement. Specifically, the lid member 20 is positioned to cover the open base 42 of the body member 40. Preferably, the lid member channels 32 and base channels 58 may be aligned with one another and engaged in a friction fit relationship. Further, the lid member side walls 30 may be slightly wider than exterior surfaces of the body member rocker portion 52 so as to be coupled thereto in a friction fit engagement (FIG. 1*a*). When the lid member 20 is coupled to the body member 40, the balance device 33 is received into the reservoir 50 (FIG. 1*b*). In this configuration, a user may stand atop the outer surface 22 of the lid member 20 and balance the rocker portion 52 which teeters or rocks laterally on the annular rocker portion 52 depending on which side of the lid member 20 is experiencing more of the user's weight. While balancing the balance board, a user may perform various exercises using resistance bands. It is believed that performing arm exercises with a resistance band is more effective when simultaneously balancing the rocker board. The lid member 20 may be removed from the body member 40 by overcoming the friction or snap fit. When the lid member 20 is coupled to the body member 40 as described above, the lid member 20 prevents access to the body member storage area. By contrast, access to the storage area is possible when the lid member 20 is removed from the body member 40.

The lid member 20 may also be selectively coupled to the body member 40 as illustrated in FIGS. 2*a*, 2*b*, 4*a*, 4*b*, and 6. In this configuration, the body member 40 is inverted as shown in FIG. 6 and the lid member 20 is lowered onto the rocker portion 52 such that respective flanges 36 selectively engage respective receiver channel(s) 54 in a friction fit engagement (FIG. 4*b*). In this configuration, the lid member 20 is held in a stabilized, unmovable configuration in that the rocker portion 52 is not touching a support surface so as to cause the apparatus to rock side to side. A user may step or stand upon the lid member 20 much as he would a traditional step platform and exercise with or without the use of resistance bands.

It is understood that the exercise apparatus 10 described above may only be in one of the two selective configurations at a time. In other words, the lid member 20 may be selectively coupled to the body member base 42 when not coupled to the body member rocker portion(s) 52. Likewise, the lid member 20 may be coupled to the body member rocker portion(s) 52 when not coupled to the body member base 42.

In another aspect of the invention, the lid member 20 may be completely removed from the body member 40 and used for exercise. In this configuration, the lid member 20 may be referred to as a "wobble board." As shown in FIG. 7*a*, the lid member 20 may be positioned so that the balance device 33 bears against a support surface. Similar to the operation of the rocker portion 52 described above, the lid member 20 teeters side to side depending on the weight position of a user standing atop the outer surface 22 of the lid member 20. It is understood that the surface area of the lower portion 35 of the balance device 33 is smaller than that of the rocker portion 52, making it much more challenging to a user to maintain balance.

It is understood that while certain forms of this invention have been illustrated and described, it is not limited thereto except insofar as such limitations are included in the following claims and allowable functional equivalents thereof.

The invention claimed is:

1. A fitness apparatus for exercising with stretchable and resilient resistance bands, comprising:

a body member having a base and a rocker portion extending away from said base, said rocker portion having a generally convex configuration;

a lid member having a generally planar configuration removably coupled to said body member;

wherein said lid member defines a pair of oppositely disposed lid member channels configured to receive resistance bands therethrough for repositionable use in exercise by a user;

wherein:

said rocker portion of said body member defines an interior area and said base defines an open configuration providing access to said interior area of said rocker portion;

said lid member is releasably coupled to said base of said body member so as to prevent access to said interior area of said rocker portion of said body member when said lid member is coupled to said base of said body member and to permit access to said interior area of said rocker portion when said lid member is not coupled to said base of said body member;

said body member includes a reservoir situated in said interior area of said rocker portion having a generally tubular configuration and defining open ends;

said lid member includes an outer surface and an inner surface;

said lid member includes a balance device coupled to said inner surface and having a convex configuration, said balance device extending away from said inner surface; and said balance device includes a configuration complementary to a configuration of said reservoir such that said balance device is nested in said reservoir when said lid member is coupled to said body member.

2. The fitness apparatus as in claim 1, wherein said base of said body member defines a pair of oppositely disposed channels of said body member that are aligned with said channels of said lid member when said lid member is coupled to said base of said body member so as to selectively receive the resistance bands therethrough.

3. The fitness apparatus as in claim 1, wherein said interior area of said rocker portion of said body member is configured to receive fitness equipment therein.

4. The fitness apparatus as in claim 1, wherein:

said lid member includes opposed first and second ends, said channels of said lid member being adjacent said first and second ends, respectively; and each channel includes a generally T-shaped configuration.

5. The fitness apparatus as in claim 4, wherein each of said first and second ends of said lid member defines at least one notch having a configuration complementary to a resistance band whereby to selectively receive the resistance band.

6. The fitness apparatus as in claim 4, wherein said lid member includes a pair of opposed base side walls extending between said opposed first and second ends, each of said pair of opposed base side walls defining at least one cutout having a configuration complementary to a resistance band whereby to selectively receive the resistance band.

7. The fitness apparatus as in claim 1, wherein said lid member includes a pair of side walls having a configuration complementary to an exterior surface of said rocker portion of said body member such that said lid member is selectively coupled to said rocker portion exterior surfaces of said body member in a friction fit engagement.

8. The fitness apparatus as in claim 1, wherein:

said lid member includes an inner surface and an opposed outer surface;

said inner surface of said lid member includes at least one inner surface flange;

said rocker portion of said body member includes an exterior surface that defines at least one receiver channel having a configuration that is complementary to a configuration of said flange of said inner surface such that said flange of said inner surface is selectively received by said at least one receiver channel so as to couple said lid member to said rocker portion of said body member.

9. The fitness apparatus as in claim 1, wherein said outer surface of said lid member includes a gripping texture.

10. The fitness apparatus as in claim 1, wherein said rocker portion of said body member extends from said base of said body member in a generally hemispherical configuration.

11. The fitness apparatus as in claim 1, wherein said rocker portion of said body member has an annular configuration relative to said base of said body member.

* * * * *